US005549502A

United States Patent [19]

Tanaka et al.

[11] Patent Number: 5,549,502

[45] Date of Patent: Aug. 27, 1996

[54] POLISHING APPARATUS

[75] Inventors: Kohichi Tanaka; Hiromasa Hashimoto, both of Nishigoh-mura; Yasuo Inada; Makoto Nakajima, both of Nagano, all of Japan

[73] Assignees: Fujikoshi Machinery Corp.; Shin-Etsu Handotai Co., Ltd., both of Japan

[21] Appl. No.: 162,679

[22] Filed: Dec. 6, 1993

[30] Foreign Application Priority Data

Dec. 4, 1992 [JP] Japan ..... 4-350115
Dec. 4, 1992 [JP] Japan ..... 4-350116

[51] Int. Cl.[6] ..... B24B 1/00

[52] U.S. Cl. ..... 451/8; 451/41; 451/158; 451/160

[58] Field of Search ..... 451/8, 9, 41, 158, 451/159, 160, 267, 285, 288, 291, 411, 460

[56] References Cited

U.S. PATENT DOCUMENTS

| | | | |
|---|---|---|---|
| 3,254,454 | 6/1966 | Cetrangolo | 451/160 |
| 3,793,779 | 2/1974 | Perrella | 451/158 |
| 4,318,250 | 3/1982 | Klievoneit et al. | 451/160 |
| 5,095,661 | 3/1992 | Gill, Jr. et al. | 451/159 |
| 5,123,214 | 6/1992 | Ishimura et al. | 451/287 |
| 5,140,774 | 8/1992 | Onodera | 451/291 |
| 5,174,067 | 12/1992 | Hasegawa et al. | 451/290 |
| 5,329,732 | 7/1994 | Karlsnud et al. | 451/290 |
| 5,333,413 | 8/1994 | Hashimoto | 451/290 |
| 5,361,545 | 11/1994 | Nakamura | 451/290 |

FOREIGN PATENT DOCUMENTS

| | | |
|---|---|---|
| 2159722 | 6/1990 | Japan . |
| 521406 | 1/1993 | Japan . |

*Primary Examiner*—M. Rachuba

*Attorney, Agent, or Firm*—Ostrolenk, Faber, Gerb & Soffen, LLP

[57] ABSTRACT

A grinding method and apparatus having a position aligning mechanism to correctly achieve the centering of each work on a work table and locate an orientation flat part of each work at a predetermined position, and a displacing mechanism for reciprocally slidably displacing a top ring and the work table in order to assure that the center of each work is positionally aligned with the center of each top ring at an original position after completion of the centering of each work on the work table and the locating of the orientation flat part, and subsequently, centering each top ring with the gravitational center of each work so as to cancel a positional offset state prior to holding the work with the top ring to thrust the work against the grinding or polishing surface. The invention also includes a polishing method and apparatus in which both of a top ring and a rotary disc are reciprocally slidably displaced to improve the polishing efficiency of the device.

19 Claims, 7 Drawing Sheets

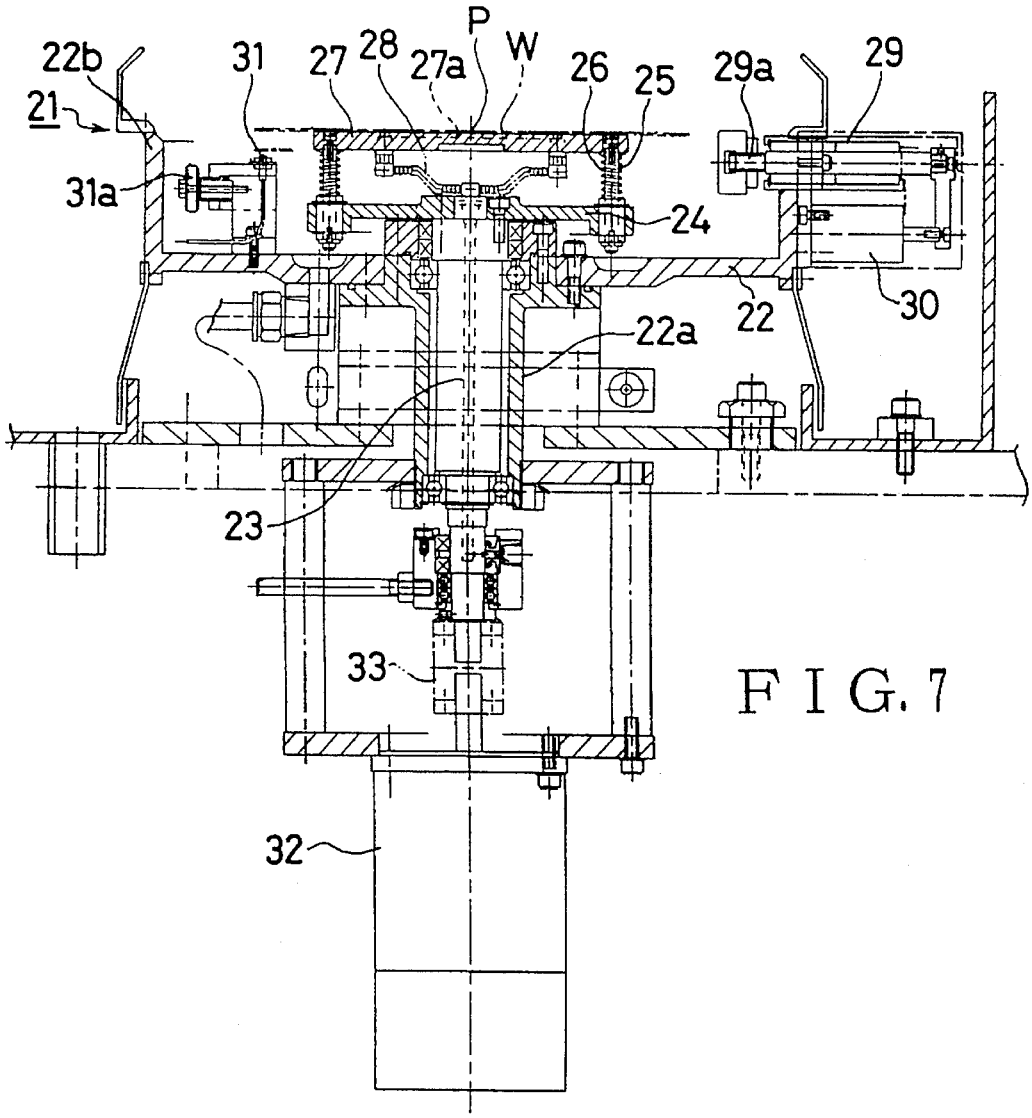
F I G. 7
F I G. 8
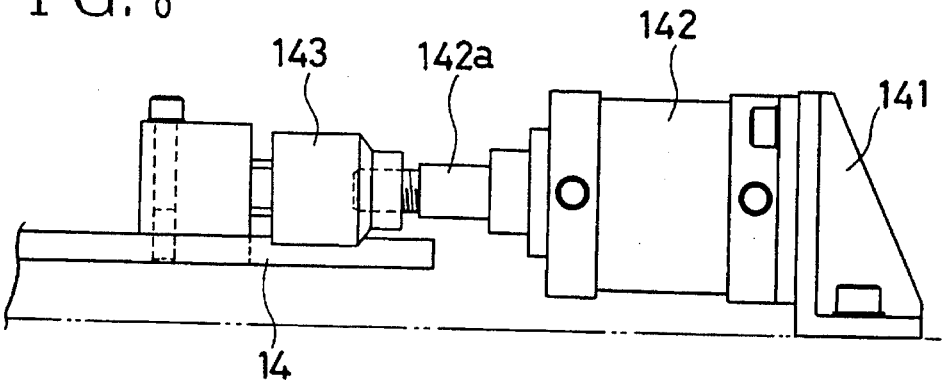

POLISHING APPARATUS

BACKGROUND OF THE INVENTION

1. Field of the Invention

The present invention relates generally to a grinding apparatus for grinding works such as semiconductor wafers or the like. More particularly, the present invention relates to improvement of a grinding apparatus of the foregoing type which assures that a grinding operation can uniformly be achieved with the aid of a work position aligning mechanism and a displacing mechanism for reciprocally slidably displacing top rings having works absorptively secured thereto. Further, the present invention relates to a polishing apparatus for polishing wafers such as semiconductor wafers or the like.

2. Background Art

A conventional grinding apparatus for grinding a wafer (work) such as a semiconductor wafer or the like is usually constructed such that a wafer to be ground is absorptively secured to a top ring and the wafer is then thrust against a rotary table having an abrasive cloth adhesively placed thereon so as to allow the wafer to be ground while a lubricant slurry is fed between the wafer and the abrasive cloth on the rotary table.

To achieve a grinding operation with the foregoing type of grinding apparatus at a high level of accuracy, it is required that the wafer is uniformly thrust against the abrasive cloth on the rotary table over the whole surface of the latter. To meet the requirement, it is necessary that the center of the top ring is exactly located in positional alignment with the gravitational center of the wafer.

In many cases, however, the semiconductor wafer is not prepared with a completely circular contour, and moreover, an orientation flat part is formed at a part of the outer periphery of the wafer. Thus, a geometrical center of the wafer defined on the assumption that the wafer is prepared with a completely circular contour (hereinafter referred to simply as a center of the wafer) is not positionally coincident with the gravitational center of the wafer. In addition, when the upper surface of the wafer does not extend in parallel with the lower surface of the same, i.e., the wafer does not have a constant thickness over the whole surface thereof, there arises a malfunction that the center of the wafer is positionally offset from the gravitational center of the same when the wafer is absorptively secured to a top ring of the grinding apparatus. This leads to the result that it can not be expected that a grinding operation is reliably achieved at a high accuracy because a certain intensity of thrusting power is not uniformly applied to the wafer.

In the circumstances as mentioned above, a method of properly locating a wafer via calculations conducted in consideration of the relationship between the center of a wafer to be ground and the gravitational center of the same has been already proposed as disclosed in an official gazette of Japanese Patent Laid-Open Publication NO. 2-159722, of which patent application was filed by an applicant common to the present invention.

However, since a grinding apparatus for which the foregoing method is employed is constructed such that a top ring is arranged separately from a work holding table, there arises a problem that mechanical components constituting the grinding apparatus are fabricated and assembled together with many difficulties in order to assure that the central position of the top ring is positionally coincident with the gravitational center position of a work to be ground.

In the case that a polishing operation is performed with the conventional grinding apparatus described above, since the position of the top ring and the center of rotation of a rotary table are always kept constant, the locus along which the wafer comes in contact with an abrasive cloth is transferred to the surface of the wafer, causing ring-shaped ruggedness to appear on the ground surface of the wafer, resulting in a machining accuracy of the polishing operation being degraded. In addition, it has been found that a part of the abrasive cloth on the rotary table corresponding to the ground part of the wafer is locally worn for a short time, resulting in an incorrect polishing operation being accelerated performed. Thus, there arises an overly-frequent necessity that the prematurely worn abrasive cloth is replaced with a new one.

SUMMARY OF THE INVENTION

The present invention has been made in consideration of the aforementioned background.

The present invention provides a grinding apparatus including a work position aligning mechanism and a displacing mechanism for grinding work such as semiconductor wafers or the like at a high accuracy wherein the grinding apparatus assures that the center of each top ring can exactly be aligned with the gravitational center of each work when the work is absorptively secured to the top ring.

The present invention also provides a polishing apparatus including a work position aligning mechanism and a displacing mechanism for polishing works such as semiconductor wafers or the like after completion of a grinding operation wherein each polishing operation can be achieved at a high accuracy not only without an occurrence of local wearing of an abrasive cloth adhesively placed on a rotary table, but also with a reduced number of abrasive cloths to be replaced with a new one every time the present abrasive cloth is completely worn.

According to one aspect of the present invention, there is provided a grinding method and apparatus for grinding works such as semiconductor wafers or the like by holding each work on the lower surface of each top ring and then displacing the top ring on the working surface of a rotary table having an abrasive cloth adhesively secured thereto while thrusting the works against the rotary disc, wherein each grinding operation is performed by way of steps of correctly centering the works held on work holding tables, locating an orientation flat part of each work at a predetermined position, displacing the top ring on the work holding table so as to allow the center of each top ring to be correctly located in positional alignment with the gravitational center of each work, and then lowering the top ring until the lower surface of each work held by each top ring is brought in close contact with the abrasive cloth on the rotary table to be rotated: the grinding apparatus comprises a position aligning mechanism including at least the work holding tables so as to achieve the centering of each work and locate the orientation flat part of each wafer at the predetermined position, and a displacing mechanism for reciprocally slidably displacing at least one of the top rings and the work holding table in order to assure that the center of each work is positionally aligned with the center of each top ring at an original position after completion of the centering of each work and the locating of the orientation flat part, and subsequently, the center of each top ring is positionally aligned with the gravitational center of each work to cancel a positional offset state.

It is recommendable that the position aligning mechanism is composed of a work holding table dimensioned to have a diameter smaller than that of each work and including an absorbing mechanism and a rotary mechanism, a centering jig disposed in the vicinity of the work holding table in a concentrical relationship relative to the latter, the centering jig being displaced not only outside of the outer periphery of the work holding table but also inside of the same with a predetermined stroke, and an orientation flat part detecting sensor disposed in the vicinity of the work holding table.

With the grinding apparatus constructed in the above-described manner, work centering and orientation flat part locating are achieved on the work holding table of the position aligning mechanism so that the center of each work is positionally aligned with the center of each top ring to define an original position for the work and the top ring. Subsequently, the positional offset state is canceled by displacing the top ring from the original position so that the center of the top ring is positionally aligned with the gravitational center of the work. While the foregoing state is maintained, each work is absorptively secured to the top ring.

In addition, according to another aspect of the present invention, there is provided a polishing method and apparatus for polishing works such as semiconductor wafers or the like by rotating a rotary table having an abrasive cloth adhesively secured to the working surface thereof while thrusting the works against the abrasive cloth on the rotary table via top rings, wherein the polishing apparatus includes as essential components a top ring holding portion adapted to be reciprocally slidably displaced while holding the top rings thereon, a driving power source for driving the top ring holding portion, and a displaceable table for reciprocally displaceably holding the rotary table thereon, and a driving power source for driving the displaceable table. With the polishing apparatus constructed as described above, the top rings and the rotary table are reciprocally slidably displaced such that the distance between the center of the top ring holding portion and the center of the rotary table relatively varies regardless of whether the direction of displacement of the top rings is coincident with the direction of displacement of the rotary table or not.

Since the displaceable table is reciprocally slidably displaced such that the distance between the center of the top ring holding portion and the center of the rotary table relatively varies regardless of whether the direction of displacement of the top rings having the wafers held thereon is coincident with the direction of displacement of the top ring holding portion or not, the locus along which the wafers come in close contact with the abrasive cloth on the rotary table always varies. In other words, since the wafers are uniformly brought in contact with the abrasive cloth over the whole surface of the latter, there does not arise a malfunction that the abrasive cloth is locally worn during each polishing operation.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which:

FIG. 7 is a vertical sectional view of one of the position aligning mechanisms shown in FIG. 6, particularly showing essential components constituting each of the position aligning mechanisms; and FIG. 8 is a fragmentary side view of the grinding apparatus, particularly showing by way of example a driving section for a displacing mechanism arranged for the grinding apparatus according to another embodiment of the present invention.

DETAILED DESCRIPTION OF THE PREFERRED EMBODIMENTS

The present invention will now be described in detail hereinafter with reference to the accompanying drawings which illustrate a few preferred embodiments thereof.

Figure 1:
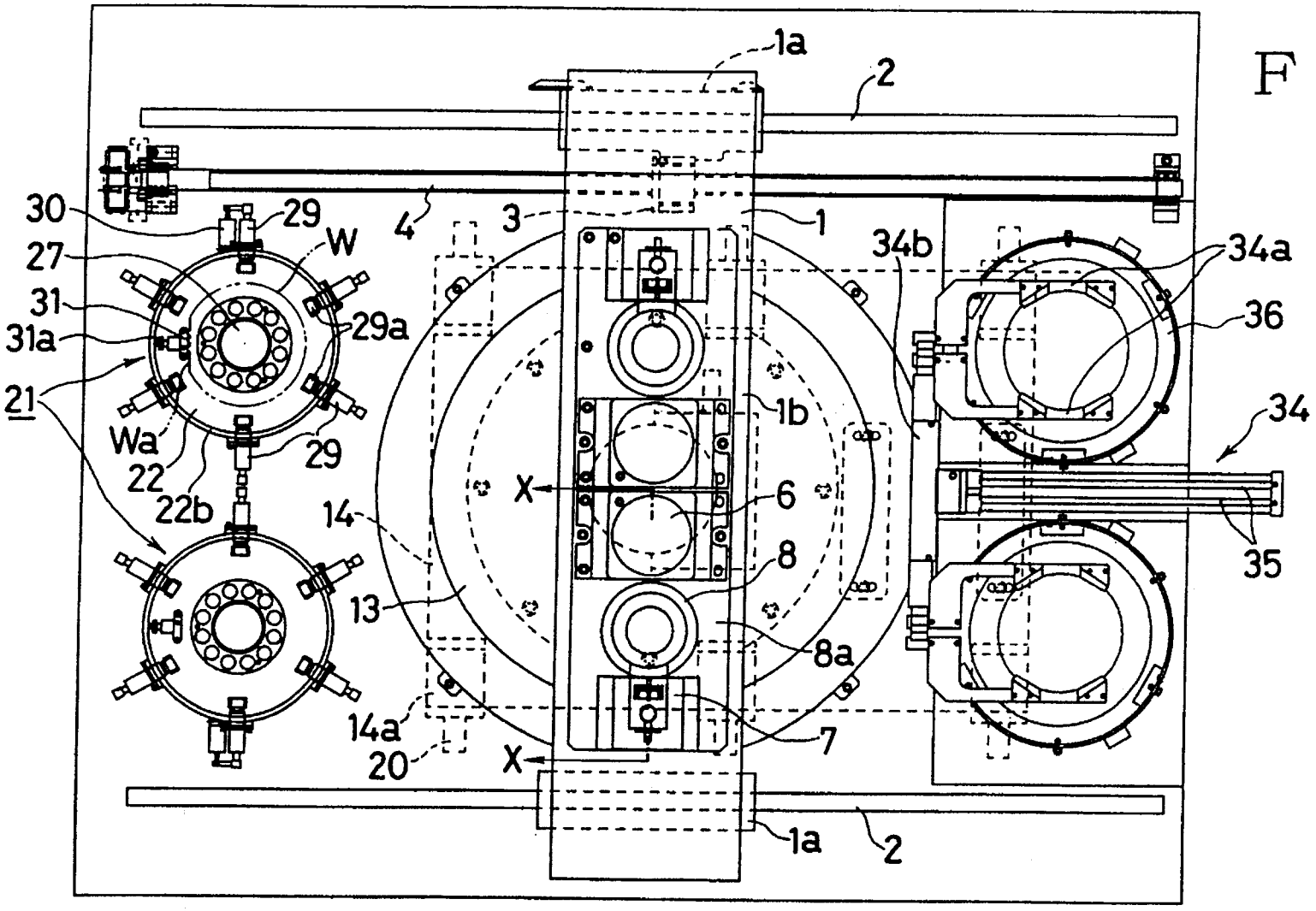
FIG. 1 is a plan view of a grinding apparatus constructed according to an embodiment of the present invention, particularly showing essential components constituting the grinding apparatus.

FIG. 1 is a plan view of a grinding apparatus constructed according to an embodiment of the present invention. In the drawing, reference numeral 1 designates a substantially inverted U-shaped top ring holding portion. The lower ends of the opposite feet la of the top ring holding portion 1 are slidably engaged with a pair of guide rails 2 extending in parallel with each other. A ball screw holder 3 fixedly secured to one of the feet la is threadably engaged with a ball screw shaft 4 extending in parallel with the guide rails 2 so that the top ring holding portion 1 is slidably displaced along the guide rails 2 in the leftward/rightward direction as the ball screw shaft 4 is rotated in the normal/reverse direction.

Figure 2:
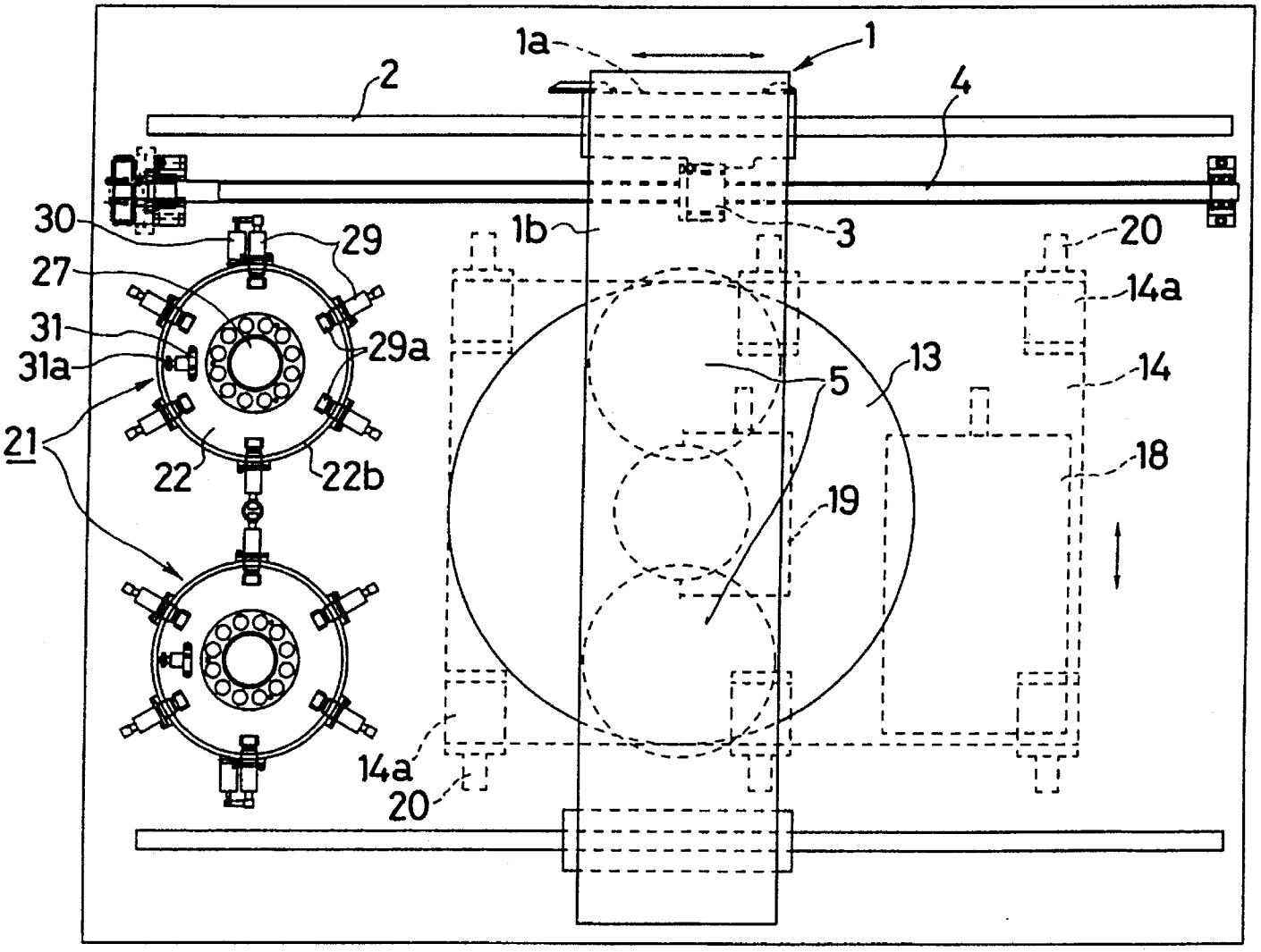
FIG. 2 is a plan view of the grinding apparatus similar to FIG. 1, particularly showing the positional relationship between top rings and a position determining mechanism.

As shown in FIG. 2, two top rings 5 are diametrically arranged below the lower surface of a horizontal beam **1*b* of the top ring holding portion 1 while orienting in the downward direction, and each of the top rings 5 is constructed such that it is rotated by activating a driving motor 6 mounted on the horizontal beam 1*b*, and moreover, it is vertically displaced by actuating a cylinder 7 (FIGS. 1, 3**) mounted on the same.

Figure 3:
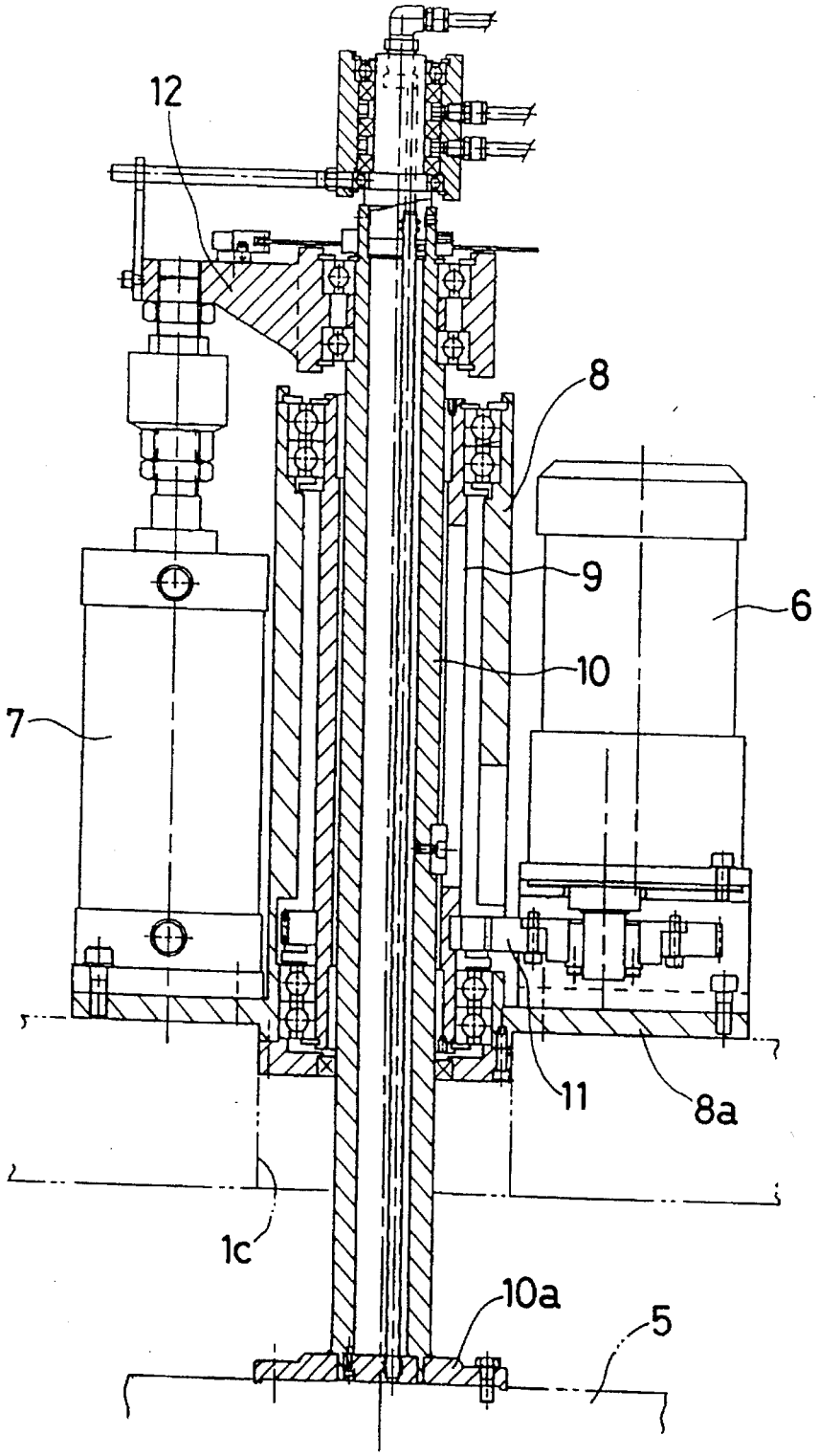
FIG. 3 is a fragmentary enlarged vertical sectional view of the grinding apparatus taken along line X—X in FIG. 1, particularly showing the structure of a top ring and associated components.

Specifically, as shown in FIG. 3, a flange-shaped seat member **8*a* of a cylindrical housing 8 is immovably mounted on the horizontal beam 1*b* of the top ring holding portion 1, and a rotary sleeve 9 is received in the cylindrical housing 8, and moreover, a support sleeve 10 is received in the rotary sleeve 9 in such a manner as to slidably move in the axial direction relative to the rotary sleeve 9. Thus, the rotation of the drive motor 6 is transmitted to the rotary sleeve 9 via a pair gears 11 meshing with each other so that the rotary sleeve 9 is rotationally driven together with the support sleeve 10 by activating the drive motor 6**.

On the other hand, the vertical displacement of a working rod of the vertical cylinder 7 immovably mounted on the seat member 8*a* is transmitted to the support sleeve 10 via a stay 12 so that the support sleeve 10 is displaced in the upward/downward direction relative to the rotary sleeve 9. The support sleeve 10 is projected downward of a hole 1*c* formed through the horizontal beam 1*b*, and a flange portion 10*a* at the lower end of the support sleeve 10 is secured to one of the top rings 5.

Figure 4:
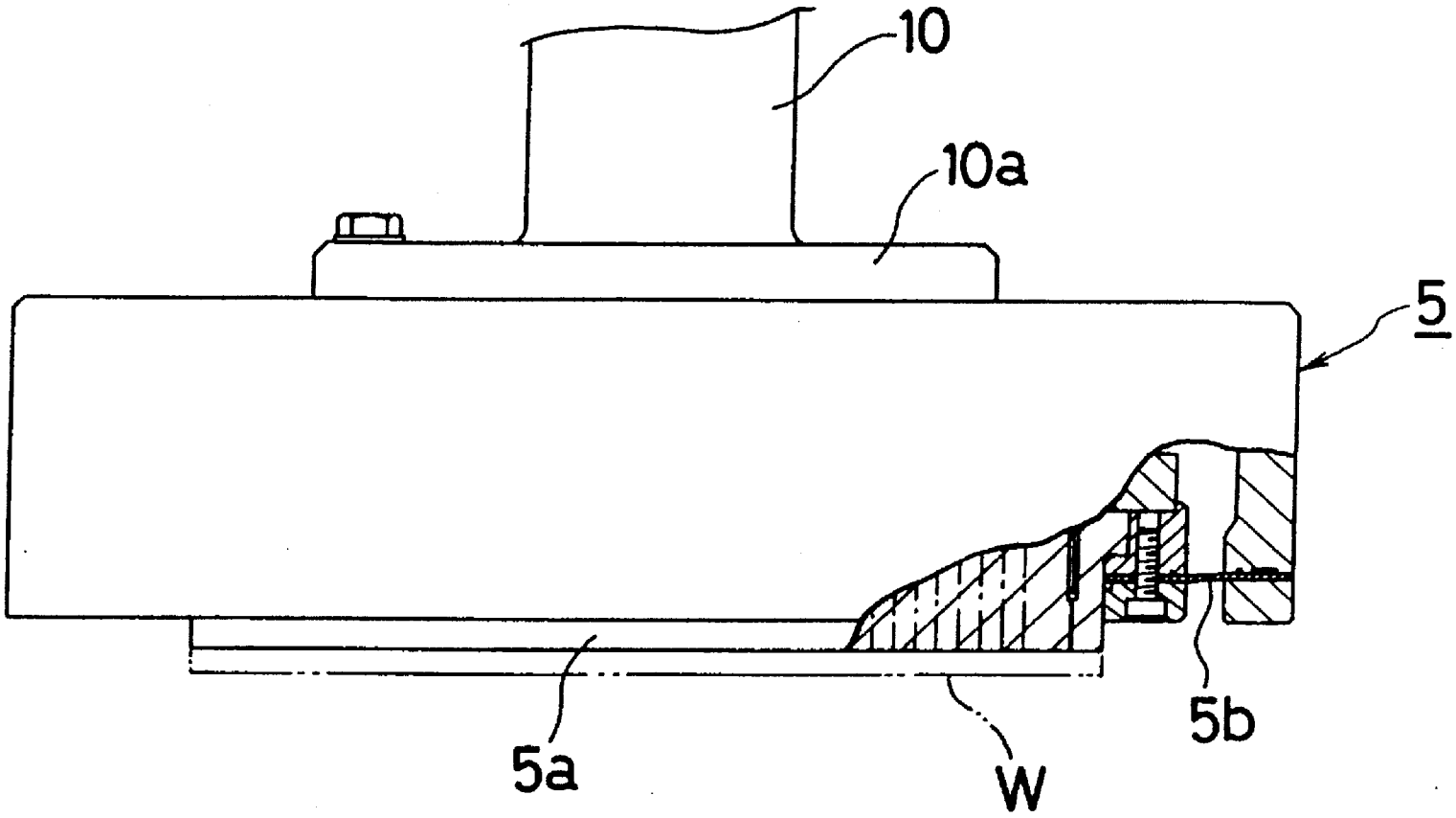
FIG. 4 is a partially sectioned side view of the top ring shown in FIG. 3.

As shown in FIG. 4, each top ring 5 is constructed such that an absorbing disc 5*a* disposed at the lower end of the top ring 5 is secured to the top ring 5 in the floated state with an elastic material 5*b* interposed therebetween so as to allow a wafer W to be absorptively secured to the absorbing disc 5*a*.

Figure 5:
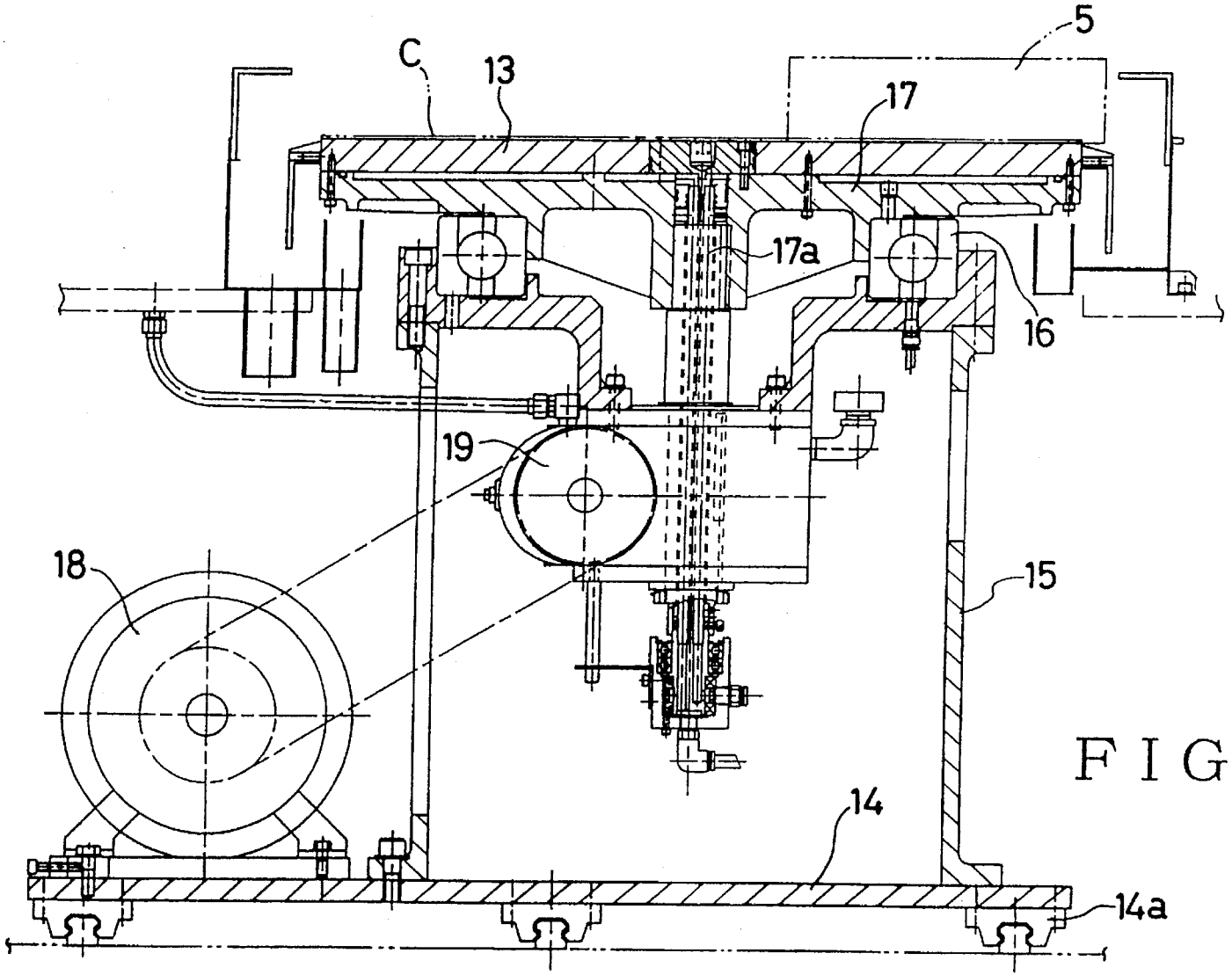
FIG. 5 is a fragmentary vertical sectional view of the grinding apparatus, particularly showing the structure of a rotary table section.

In FIG. 5, reference numeral 13 designates a rotary table. The rotary table 13 is turnably mounted on a displaceable table 14. A cylindrical receiving member 15 is fixedly mounted on the displaceable table 14, and the rotary table 13 is turnably mounted on the cylindrical receiving member 15 via a bearing 16 and a table holding member 17 interposed between the rotary table 13 and the cylindrical receiving member 15 so that a driving shaft 17*a* of the table holding member 17 is rotated at a reduced speed as a drive motor 18 mounted on the displaceable table 14 is rotationally driven. At this time, a rotational speed of the drive motor 18 is then reduced with the aid of a speed reduction unit 19.

The displaceable table 14 includes four guide pieces 14*a* on the lower surface thereof at four corners, and the guide pieces 14*a* are slidably engaged with a pair of guide rails 20 extending in parallel with each other but at a right angle relative to the guide rails 2 See FIG. 1. Specifically, as is apparent from FIG. 1 and FIG. 2, the guide rails 20 are arranged at a right angle relative to the guide rails 2, causing the displaceable table 14 to be reciprocally slidably displaced at a right angle relative to the direction of displacement of the top ring holding portion 1. Thus, the rotary table 13 is displaced together with the displaceable table 14 in the direction at a right angle relative to the direction of displacement of the top ring holding member 1.

In FIG. 1 and FIG. 2, reference numeral 21 designates a position aligning mechanism. As shown in FIG. 7, a rotational shaft 23 is rotatably supported by a cylindrical portion 22a secured to a housing 22 of the position aligning mechanism 21, and a holding disc 24 is horizontally fixed to the upper end of the rotational shaft 23. A work holding table 27 is arranged above the holding disc 24 with the aid of a plurality of upright standing support shafts 25 arranged in the spaced relationship as seen in the circumferential direction of the holding disc 24 as well as a plurality of coil springs 26 fitted around the support shafts 25. The work holding table 27 is designed to have a diameter smaller than that of a wafer W, and an absorbing portion 27*a* is formed on the upper surface of the work holding table 27 to which suction pipes 28 are connected. In the drawings, reference numeral 29 designates a centering jig. In practice, a plurality of centering jigs 29 (six centering jigs 29 in the shown case(FIG. 6)) are secured to an opening portion 22*b* of the housing 22 formed around the upper end part of the housing 22 in the concentrical relationship relative to the work holding table 27, and each of the centering jigs 29 includes a centering arm 29*a* which is telescopically displaceable through the opening portion 22*b*. All the centering arms 29*a* are oriented toward the center of the work holding table 27.

Reference numeral 31 designates an orientation flat part detecting sensor. The orientation flat part sensor 31 is disposed in the opening portion 22*b* of the housing 22 at the position located in the vicinity of the work holding table 27 and slightly below the latter in order to finely adjust the present position of the wafer W by actuating an adjusting screw 31*a* depending on a size of the wafer W. The orientation flat part detecting sensor 31 serves to detect an orientation flat part Wa of the wafer W absorptively secured to the work holding table 27.

Reference numeral 32 designates a drive motor. The drive motor 32 is used to rotate the rotational shaft 23 via a coupling 33 so as to enable the work holding table 27 to be turned by a certain angle when the orientation flat part detecting sensor 31 detects the orientation flat part Wa of the wafer W.

In FIG. 1, reference numeral 34 designates a wafer taking-up/conveying unit. The wafer taking-up/conveying unit 34 includes a pair of receiving arms 34*a* which are designed not only to move in the horizontal direction along guide rails 35 but also to move in the upward/downward direction relative to a support shaft 34*b* in order to assure that wafers W are successively taken out of a pair of wafer storing sections 36 one by one.

Next, a mode of operation of the grinding apparatus constructed in the aforementioned manner will be described below. It should be noted that description will be made for the purpose of simplification only with respect to one of a pair of top rings 5, a pair of position aligning mechanisms 21 and a pair of wafer storing sections 36.

First, a wafer W is taken up from the wafer storing section 36 by activating the wafer taking-up/conveying mechanism 34 and it is then held at a predetermined position in the waiting state by the receiving arm 34*a*. Subsequently, the top ring holding portion 1 is displaced in the rightward direction as seen in FIG. 2 until the top ring 5 is correctly located above the wafer W in positional alignment with the center of the wafer W held by the receiving arms 34*a*. On completion of the positional alignment of the wafer W relative to the top ring 5, the absorbing disc 5*a* of the top ring 5 is brought in close contact with the upper surface of the wafer W, and thereafter, the top ring 5 is raised up to an original position.

While the foregoing state is maintained, the top ring holding portion 1 is displaced in the leftward direction to reach the position aligning mechanism 21 so that the wafer W is released from the absorptively held state caused by the absorbing disc 5*a*, causing the wafer W to be placed on the work holding table 27.

The position aligning mechanism 21 includes a plurality of centering jigs 29 (i.e., six centering jigs 29 in the shown case) of which centering arms 29*a* are simultaneously elongated so as to allow the wafer W to be lightly squeezed by them, and subsequently, the work holding table 27 is turned by a certain angle so that the orientation flat part Wa of the water W is detected by the orientation flat part detecting sensor 31. After completion of the wafer position alignment and the orientation flat part detection, the absorbing portion 27*a* of the work holding table 27 is activated so as to allow the wafer W to be absorptively held on the work holding table 27.

Thus, a center P of the work holding table 27 can correctly be aligned with a center 0 of the wafer W by the aforementioned steps. Here, it should be noted that the center 0 of the wafer W is positionally offset from a gravitational center G of the wafer W because of the formation of the orientation flat part Wa on the wafer W.

Figure 6:
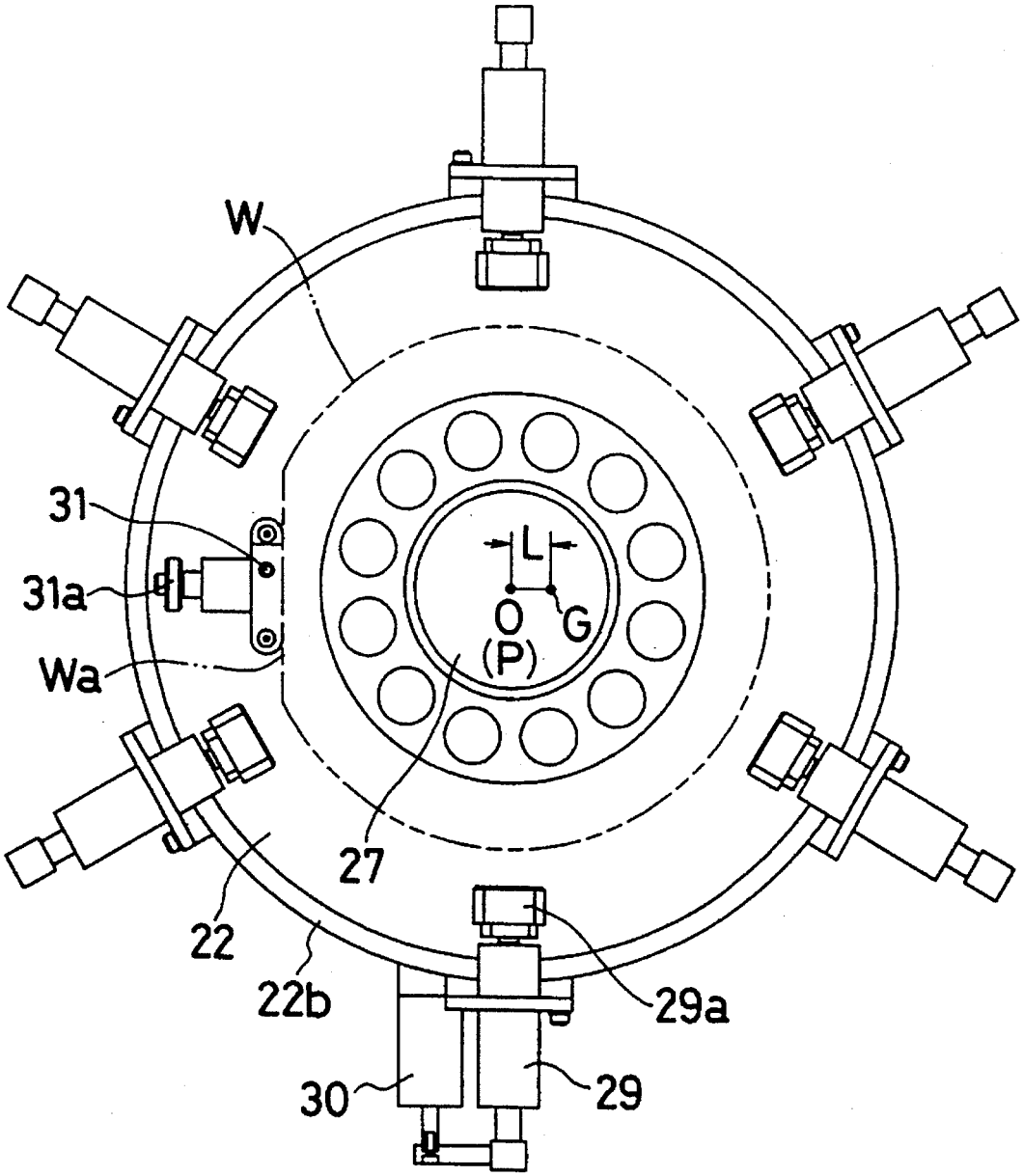
FIG. 6 is a fragmentary plan view of the grinding apparatus, particularly showing the structure of a position determining mechanism.

Subsequently, the foregoing positional offset is canceled in the following manner. First, a center Q of the top ring 5 is positionally aligned with the center 0 of the wafer W (i.e., the center P of the work holding table 27) by performing an original position determining operation, and thereafter, the center Q of the top ring 5 is displaced by a distance L corresponding to a quantity of the aforementioned positional offset as shown in FIG. 6 by slidably displacing the top ring holding portion 1 until the center Q of the top ring 5 is positionally aligned with the gravitational center G of the wafer W, whereby the positional offset canceling operation is completed. After the positional offset canceling operation is completed in that way, the wafer W is absorptively held by the absorbing disc 5*a* of the top ring 5 via air evacuation.

After the wafer W is absorptively held in the above-described manner, the top ring holding portion 1 is displaced in the rightward direction until the top ring 5 is positionally aligned with the rotary disc 13, and subsequently, the wafer W is thrusted against a grinding cloth C adhesively placed over the whole upper surface of the rotary disc 13 with a predetermined intensity of thrusting power imparted to the grinding cloth C in order to grind the wafer W with the abrasive cloth C while feeding a lubricant slurry between the wafer W and the grinding cloth C.

During the grinding operation, the top ring 5 is rotationally driven by the support sleeve 10 via the rotary sleeve 9, and at the same time, the top ring holding portion 1 is reciprocally slidably displaced with a certain stroke in the rightward/leftward direction while the rotary disc 13 held on the displaceable table 14 is reciprocally slidably displaced along the guide rails 20 in the upward/downward direction as seen in FIG. 1. This makes it possible to uniformly bring the wafer W in close contact with the abrasive cloth C over the whole upper surface of the latter.

In the shown embodiment, the top ring holding portion 1 serves as a top ring displacing mechanism so as to allow the top ring 5 to be reciprocally slidably displaced in the upward/downward direction as seen in FIG. 1. However, the present invention should not be limited only to this construction. An adequately designed top ring displacing mechanism may be arranged on the work holding table side so as to slidably displace the top ring 5 relative to the rotary table 13 in a certain different direction other than the foregoing one. The present invention has been described above with the respect to the grinding apparatus which is constructed such that a work is reciprocally slidably displaced during each grinding operation. It is obvious for any expert in the art that the work position aligning mechanism constructed according to the present invention is employable for other types of grinding apparatus rather than the aforementioned one.

According to the present invention, the center of the top ring can positionally be aligned with the gravitational center of each work, e.g., a work of semiconductor wafer having an orientation flat part formed thereon or a work having a gradually increasing thickness, i.e., a work having a certain surface inclination while the work is absorptively secured to the top ring. Thus, the work can uniformly be ground at a high accuracy with a certain intensity of thrusting power imparted thereto. Consequently, the grinding apparatus of the present invention exhibits an advantageous effect.

In addition, the position aligning mechanism is simple in structure, and moreover, it can easily be actuated. Consequently, the present invention can provide a grinding apparatus having a position aligning mechanism involved therein which assures that the grinding apparatus exhibits excellently high performances.

FIG. 8 shows by way of example the structure of a table displacing mechanism constructed according to another embodiment of the present invention for reciprocally slidably displacing the displaceable table 14. Specifically, a displacing cylinder 142 is immovably mounted at a predetermined position on a stationary platform 141, and the foremost end of a rod 142*a* of the displacing cylinder 142 is fixed to the displaceable table 14 via a floating joint 143 so that the displaceable table 14 can reciprocably be displaced in parallel with the guide rails 20 with a comparatively short stroke by reversely actuating the displacing cylinder 142.

Next, description will be made below with respect to a polishing operation to be performed by the grinding apparatus of the present invention. In other words, the grinding apparatus of the present invention can serve also as a polishing apparatus merely by exchanging the present coarse abrasive cloth with a fine abrasive cloth or a polishing cloth having very fine abrasive grains impregnated therein.

To achieve each polishing operation, the top ring 5 is rotationally driven by the support sleeve 10 via the rotary sleeve 9, and at the same time, the top ring holding portion 1 is reciprocally slidably displaced with a certain stroke in the leftward/rightward direction while the rotary table 13 held on the displaceable table 14 is reciprocally displaced in the upward/downward direction as seen in FIG. 1 along the guide rails 20, whereby the wafer W is uniformly brought in close contact with the grinding cloth C over the whole upper surface of the latter. Thus, the wafer W can be polished at a high accuracy without any local wearing of the grinding cloth C. In practice, as is best seen in FIG. 2, two top rings 5 are held by the top ring holding portion 1 although the above description has been made for the purpose of simplification on the assumption that a single top ring is held by the top ring holding portion 1. Thus, two wafers can simultaneously be mirror-finished with the grinding apparatus of the present invention.

In the shown embodiment, to achieve each polishing operation, the direction of displacement of the top rings 5 is determined at a right angle relative to the direction of reciprocally displacement of the rotary disc 13. However, the present invention should not be limited only to this. Alternatively, the direction of displacement of the top rings 5 may be coincident with the direction of displacement of the rotary disc 13 wherein the distance between the center of the top ring holding portion and the center of the rotary disc relatively varies. At any rate, it is required that wafers to be ground or polished are uniformly brought in close contact with the abrasive cloth over the whole upper surface of the latter without any local wearing of the abrasive cloth.

Thus, the present invention has provided a polishing apparatus including a rotary table having an abrasive cloth adhesively secured to the working surface of the rotary table so as to allow each wafer to be uniformly thrust against the abrasive cloth on the rotary table wherein the distance between the center of the top ring holding portion and the center of the rotary disc relatively varies regardless of whether the direction of displacement of the top ring is coincident with the direction of displacement of the rotary table or not. Consequently, the wafer to be polished is uniformly brought in close contact with the abrasive cloth over the whole upper surface of the latter, whereby each polishing operation can be achieved at a high accuracy not only without any local wearing of the polishing paper but also with a reduced number of abrasive cloths to be replaced.

While the present invention has been described above with reference to a few preferred embodiments thereof, it should of course be understood that the present invention should not be limited only to these embodiments but various changes or modifications may be made without departure from the scope of the present invention as defined by the appended claims.

What is claimed is:

1. An apparatus for polishing works, each of said works having an orientation flat part, the apparatus comprising:

a work table;

a top ring for holding said work against said work table;

a position aligning mechanism for centering said work on said work table;

an orientation flat part positioning mechanism for positioning said orientation flat part of said work at a predetermined position on said work table; and a displacing mechanism for reciprocally slidably displacing at least one of said top ring and said work table to align the center of said work with the center of said top ring, and subsequently, for aligning the center of said top ring with the gravitational center of said work.

2. The apparatus according to claim 1, wherein said work table has a diameter smaller than that of said work, and said position aligning mechanism further comprises:

an absorbing mechanism for holding said work on said work table;

a rotary mechanism for rotating said work table;

a centering jig disposed around said work table for centering and aligning said work on said work table; and an orientation flat part detecting sensor disposed in the vicinity of said work table.

3. A polishing apparatus for polishing works by rotating a rotary disc having an abrasive cloth adhesively secured to the working surface thereof while thrusting said work against said abrasive cloth on said rotary disc via top rings, the polishing apparatus comprising:

a top ring holding portion adapted to be reciprocally slidably displaced while holding said top rings;

a driving power source for reciprocally displaceably driving said top ring holding portion;

a displaceable table for holding said rotary disc; and a driving power source for reciprocally displaceably driving said displaceable table;

wherein said top rings and said rotary disc are reciprocally slidably displaceable while polishing said work by thrusting said work against said abrasive cloth on said rotary disc via said top rings such that the distance between the center of said top ring holding portion and the center of said rotary disc relatively varies regardless of whether the direction of displacement of said top rings is coincident with the direction of displacement of said rotary disc or not.

4. A method of polishing works comprising the steps of:

holding a work with a top ring;

lowering said top ring until the lower surface of said work is brought in close contact with an abrasive cloth on a rotary disc to be rotated;

aligning the center of said work on said work table;

positioning an orientation flat part of said work at a predetermined position;

displacing at least one of said top ring and said work table to align the center of said work with the center of each top ring at a position corresponding to an original center position after completion of said centering of said work on said work table and said locating of said orientation flat part; and aligning the center of each top ring with the gravitational center of said work.

5. A method for polishing works by rotating a rotary disc having an abrasive cloth adhesively secured to the working surface thereof while thrusting said work against said abrasive cloth on said rotary disc via top rings, said rotary disc being held on a displaceable table; the method comprising the steps of:

reciprocally displaceably driving said top ring holding said work; and reciprocally displaceably driving said displaceable table;

wherein said top rings and said rotary disc are reciprocally slidably displaced while polishing said work by thrusting said work against said abrasive cloth on said rotary disc via said top rings such that the distance between the center of said top ring holding portion and the center of said rotary disc relatively varies regardless of whether the direction of displacement of said top rings is coincident with the direction of displacement of said rotary disc or not.

6. The polishing apparatus according to claim 3, further comprising a top ring for supporting the work.

7. The polishing apparatus according to claim 6, wherein said top ring is provided for supporting the work detachably.

8. The polishing apparatus according to claim 6, further comprising a work supported by said top ring.

9. The polishing apparatus of claim 8, wherein said work is supported detachably.

10. The polishing apparatus of claim 6, wherein said top ring is adapted to be rotatable.

11. The polishing apparatus according to claim 10, further comprising a work supported on said rotatable top ring.

12. The polishing apparatus of claim 11, wherein said work rotates with said rotatable top ring.

13. The polishing apparatus of claim 11, wherein said work is detachably supported on said rotatable top ring.

14. The method for polishing works according to claim 5, further comprising the step of supporting said work with said top ring.

15. The method for polishing works according to claim 14, wherein the work is detachably supported with said top ring.

16. The method for polishing works according to claim 5, further comprising the step of rotating said top ring.

17. The method for polishing works according to claim 16, further comprising the step of supporting said work using said top ring.

18. The method for polishing works according to claim 17, further comprising the step of rotating said work supported by said top ring.

19. The method for polishing works according to claim 17, wherein said work is detachably supported by said top ring.

* * * * *